US009335675B1

(12) United States Patent
Shimada et al.

(10) Patent No.: US 9,335,675 B1
(45) Date of Patent: May 10, 2016

(54) IMAGE FORMING APPARATUS AND TRANSFER VOLTAGE SETTING METHOD

(71) Applicant: FUJI XEROX CO., LTD., Tokyo (JP)

(72) Inventors: Yasuhiro Shimada, Kanagawa (JP); Masaaki Yamaura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/883,052

(22) Filed: Oct. 14, 2015

(30) Foreign Application Priority Data

May 18, 2015 (JP) ..... 2015-100930

(51) Int. Cl.
*G03G 15/16* (2006.01)

(52) U.S. Cl.
CPC ..... *G03G 15/1675* (2013.01)

(58) Field of Classification Search
CPC ..... G03G 15/1675
USPC ..... 399/66
See application file for complete search history.

(56) References Cited

U.S. PATENT DOCUMENTS 7,039,333 B2 * 5/2006 Do ..... G03G 15/0813 399/46
7,106,983 B2 * 9/2006 Nakayama ..... G03G 15/0121 399/39
7,239,831 B2 * 7/2007 Hagiwara ..... G03G 15/065 399/150
8,781,348 B2 7/2014 Ogino et al.
9,046,830 B2 * 6/2015 Tanaka ..... G03G 15/1675
9,075,350 B2 * 7/2015 Tanaka ..... G03G 15/1605
9,081,335 B2 * 7/2015 Sugimoto ..... G03G 15/1675
2003/0026625 A1 * 2/2003 Tamiya ..... G03G 15/0131 399/66
2004/0218939 A1 * 11/2004 Motohashi ..... G03G 15/0266 399/50
2007/0059000 A1 * 3/2007 Shibuya ..... G03G 15/0266 399/44
2010/0054820 A1 * 3/2010 Fujihara ..... G03G 15/065 399/270
2010/0067936 A1 * 3/2010 Kitajima ..... G03G 15/5058 399/72
2010/0111551 A1 * 5/2010 Fujihara ..... G03G 15/065 399/55
2010/0129102 A1 * 5/2010 Fujihara ..... G03G 15/065 399/55
2010/0239287 A1 * 9/2010 Shibuya ..... G03G 15/0266 399/50
2010/0303518 A1 * 12/2010 Aimoto ..... G03G 15/1675 399/314
2010/0329707 A1 * 12/2010 Yamada ..... G03G 15/161 399/44
2011/0229168 A1 * 9/2011 Shiraishi ..... G03G 15/1605 399/45
2012/0045231 A1 * 2/2012 Ogino ..... G03G 15/1605 399/45
2012/0045237 A1 * 2/2012 Aoki ..... G03G 15/1675 399/66

(Continued)

FOREIGN PATENT DOCUMENTS

JP 2012-042827 A 3/2012
JP 2012-123309 A 6/2012

*Primary Examiner* — David Bolduc
(74) *Attorney, Agent, or Firm* — Oliff PLC

(57) ABSTRACT

An image forming apparatus includes an image forming unit that forms an image with toner, an image carrier, a transfer unit that transfers an image from the image carrier to a medium, and a power supply control unit that applies a transfer bias generated by superimposing an AC bias and a DC bias to the transfer unit. Multiple first images are transferred to a medium, the first images being formed by setting one of an amplitude value of the AC bias, and a DC bias value representing a value of the DC bias to a fixed value and changing the other one at a preset interval. Multiple second images are transferred to a medium, the second images being formed by setting the one of the amplitude value and the DC bias value to a fixed value different from the fixed value, and changing the other one at a preset interval.

12 Claims, 12 Drawing Sheets

(56) References Cited

U.S. PATENT DOCUMENTS

2012/0045259 A1* 2/2012 Nakamura ..... G03G 15/1605 399/314
2012/0230715 A1* 9/2012 Ogino ..... G03G 15/1675 399/66
2012/0237234 A1* 9/2012 Sugimoto ..... G03G 15/1675 399/50
2012/0243892 A1* 9/2012 Nakamura ..... G03G 15/1675 399/66
2012/0308250 A1* 12/2012 Shimizu ..... G03G 15/1645 399/66
2012/0328315 A1* 12/2012 Takeuchi ..... G03G 15/80 399/66
2012/0328321 A1* 12/2012 Takeuchi ..... G03G 15/1675 399/88
2013/0004190 A1* 1/2013 Sengoku ..... G03G 15/0189 399/66
2013/0094870 A1* 4/2013 Shimizu ..... G03G 15/1605 399/45
2013/0121714 A1* 5/2013 Tanaka ..... G03G 15/1675 399/66
2013/0136468 A1* 5/2013 Shimizu ..... G03G 15/0189 399/44
2013/0148991 A1* 6/2013 Sakata ..... G03G 15/0266 399/48
2013/0308968 A1* 11/2013 Tanaka ..... G03G 15/1675 399/44
2013/0322901 A1* 12/2013 Nakase ..... G03G 15/08 399/49
2014/0010562 A1* 1/2014 Tanaka ..... G03G 15/0131 399/66
2014/0328604 A1* 11/2014 Tanaka ..... G03G 15/1675 399/66

* cited by examiner

FIG. 10

| | | | Vdc(kVdc) | | | | | | | | | | | | | | | | | | | | |
|---|---|---|---|---|---|---|---|---|---|---|---|---|---|---|---|---|---|---|---|---|---|---|---|
| | | | -1.5 | -1.6 | -1.7 | -1.8 | -1.9 | -2.0 | -2.1 | -2.2 | -2.3 | -2.4 | -2.5 | -2.6 | -2.7 | -2.8 | -2.9 | -3.0 | -3.1 | -3.2 | -3.3 | -3.4 | -3.5 |
| Vpp | 7kVpp (Vpp1) | PK DENSITY | × | × | × | × | × | × | × | ○ | ○ | ○ | ○ | ○ | ○ | ○ | ○ | ○ | ○ | ○ | ○ | ○ | ○ |
| | | K DENSITY | ○ | ○ | ○ | ○ | ○ | ○ | ○ | ○ | ○ | ○ | ○ | ○ | ○ | ○ | ○ | ○ | × | × | × | × | × |
| | 12kVpp (Vpp1) | PK DENSITY | × | × | × | × | × | ○ | ○ | ○ | ○ | ○ | ○ | ○ | ○ | ○ | ○ | ○ | ○ | ○ | ○ | ○ | ○ |
| | | K DENSITY | ○ | ○ | ○ | ○ | ○ | ○ | ○ | ○ | ○ | × | × | × | × | × | × | × | × | × | × | × | × |

IMAGE FORMING APPARATUS AND TRANSFER VOLTAGE SETTING METHOD

CROSS-REFERENCE TO RELATED APPLICATIONS

This application is based on and claims priority under 35 USC 119 from Japanese Patent Application No. 2015-100930 filed May 18, 2015.

BACKGROUND

The present invention relates to an image forming apparatus and a transfer voltage setting method.

SUMMARY

According to an aspect of the invention, there is provided an image forming apparatus including an image forming unit that forms an image by using toner, an image carrier, a transfer unit that transfers an image from the image carrier to a medium, and a power supply control unit that applies a transfer bias to the transfer unit, the transfer bias being generated by superimposing an AC bias and a DC bias on each other, in which multiple first images are transferred to a medium, the first images being formed by setting one of an amplitude value of the AC bias and a DC bias value representing the DC bias to a fixed value and changing another one of the amplitude value and the DC bias value at a preset interval, and multiple second images are transferred to a medium, the second images being formed by setting the one of the amplitude value and the DC bias value to a fixed value different from the fixed value, and changing the other one of the amplitude value and the DC bias value at a preset interval.

BRIEF DESCRIPTION OF THE DRAWINGS

Exemplary embodiments of the present invention will be described in detail based on the following figures, wherein:

FIG. 10 illustrates the results of an experiment;

FIGS. 12A to 12D each illustrate an AC voltage, of which FIG. 12A illustrates an AC voltage with a rectangular waveform used in Exemplary Embodiment 2, FIG. 12B illustrates an AC voltage with a sinusoidal waveform used in Exemplary Embodiment 1, FIG. 12C illustrates a triangular wave, and FIG. 12D illustrates a saw-tooth wave.

DETAILED DESCRIPTION

Although specific exemplary embodiments of the present invention are described below with reference to the figures, the present invention is not limited to the exemplary embodiments below.

For the ease of understanding of the following discussion, in the figures, the front-rear direction is defined as X-axis direction, the left-right direction is defined as Y-axis direction, and the up-down direction is defined as Z-axis direction. Further, the directions or sides indicated by arrows X, −X, Y, −Y, Z, and −Z are defined as forward, rearward, rightward, leftward, upward, and downward directions, respectively, or as front, rear, right, left, upper, and lower sides, respectively.

Further, in each of the figures, a dot inside a circle represents an arrow pointing from the far side toward the near side of the plane of the figure, and a cross inside a circle represents an arrow pointing from the near side toward the far side of the plane of the figure.

In the figures used in the following discussion, for the ease of understanding, components other than those necessary for explanation are omitted as appropriate.

Exemplary Embodiment 1

Description of General Configuration of Printer U According to Exemplary Embodiment 1

Figure 1:
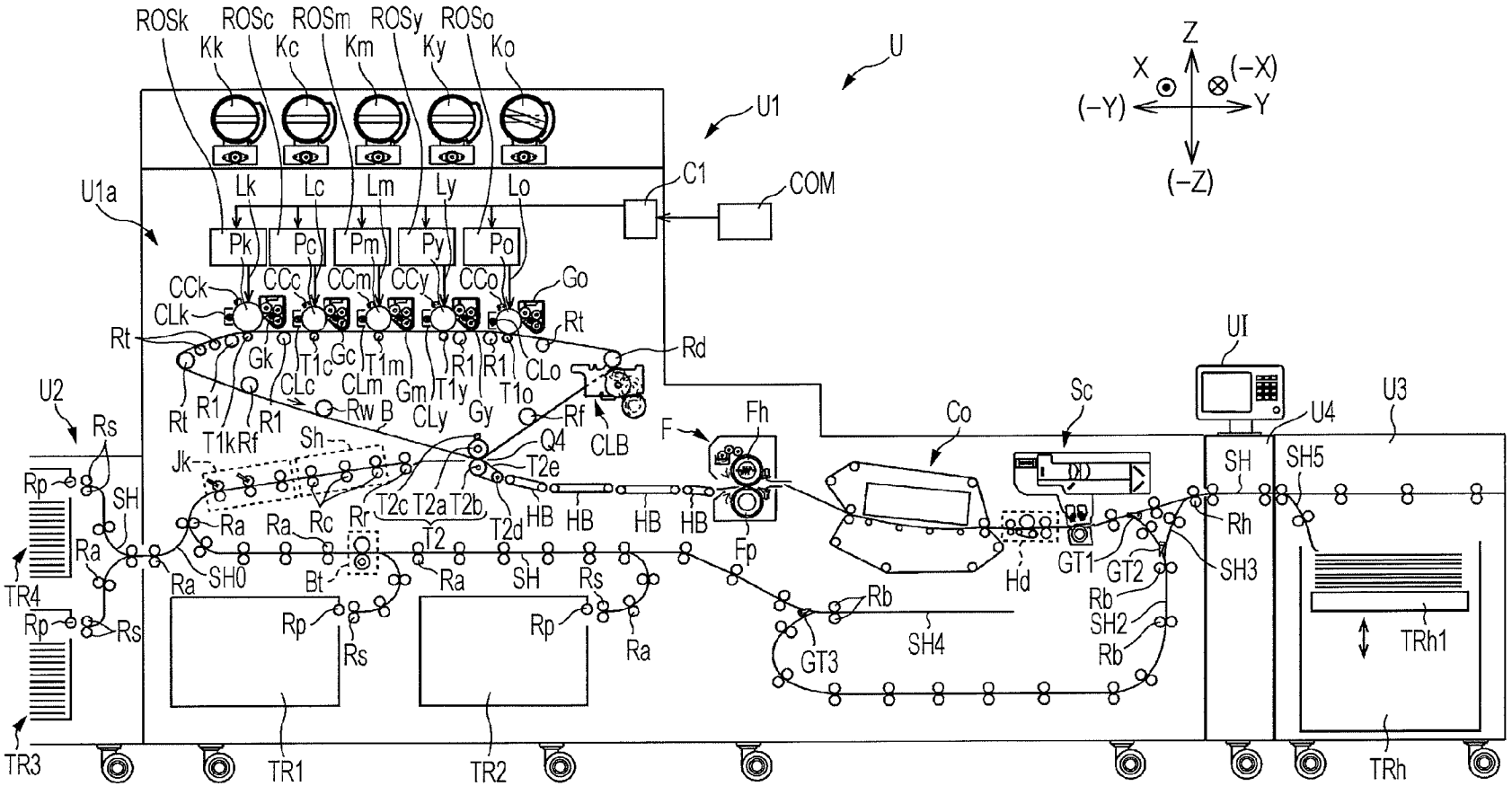
FIG. 1 illustrates a general configuration of an image forming apparatus according to Exemplary Embodiment 1 of the present invention.

FIG. 1 illustrates a general configuration of an image forming apparatus according to Exemplary Embodiment 1 of the present invention.

Figure 2:
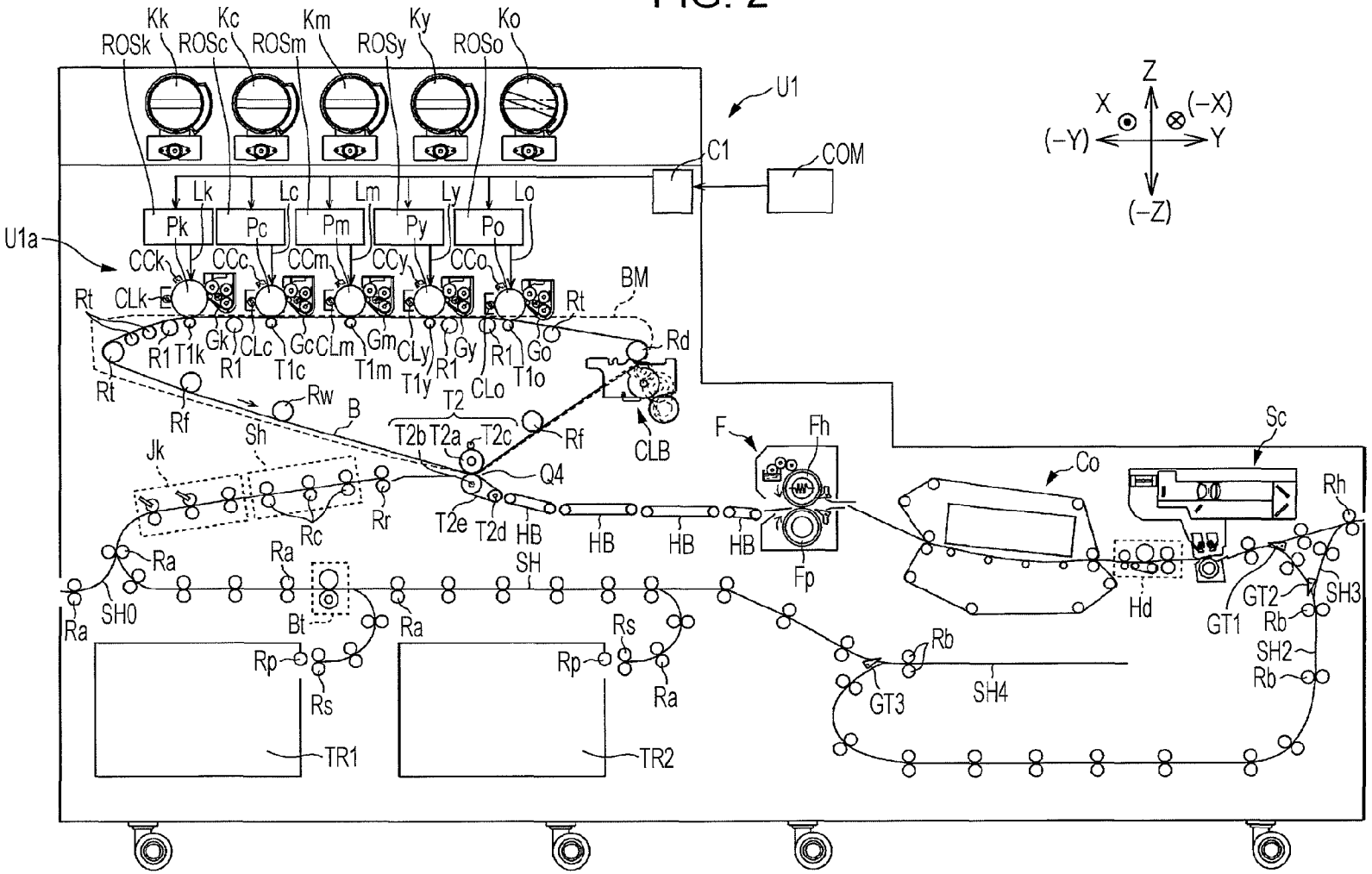
FIG. 2 illustrates major portions of the image forming apparatus according to Exemplary Embodiment 1 of the present invention.

FIG. 2 illustrates major portions of the image forming apparatus according to Exemplary Embodiment 1 of the present invention.

In FIGS. 1 and 2, a printer U as an example of the image forming apparatus according to Exemplary Embodiment 1 has a printer body U1, a feeder unit U2 as an example of a supply device that supplies a medium to the printer body U1, a discharge unit U3 as an example of a discharge device for discharging a medium on which an image has been recorded, an interface module U4 as an example of a connecting section that connects the printer body U1 and the discharge unit U3 to each other, and an operating section UI that is operated by the user.

(Description of Marking According to Exemplary Embodiment 1)

In FIGS. 1 and 2, the printer body U1 has components such as a controller C that controls the printer U, a communication section (not illustrated) that receives image information transmitted from a print image server COM, which is an example of an information transmitting device connected to the outside of the printer U via a dedicated cable (not illustrated), and a marking section U1*a* as an example of an image recording section that records an image on a medium. The print image server COM is connected with a personal computer PC via a line such as a local area network (LAN). The personal computer PC is an example of an image transmitting device for transmitting information about an image to be printed on the printer U.

The marking section U1*a* has, as an example of an image carrier, photoconductors Py, Pm, Pc, and Pk for the colors of yellow (Y), magenta (M), cyan (C), and black (K), respectively, and a photoconductor Po for a transparent image which is used in the case of printing a photographic image or the like to give gloss to the image. The surface of the photoconductors Py to Po is made of a photosensitive dielectric.

In FIGS. 1 and 2, a charging unit CCk, an exposure device ROSk as an example of a latent image forming device, a developing unit Gk, a first transfer roller T1*k* as an example of a first transfer unit, and a photoconductor cleaner CLk as an example of an image carrier cleaner are disposed around the photoconductor Pk for black along the rotational direction of the photoconductor Pk.

Likewise, charging units CCy, CCm, CCc, and CCo, exposure devices ROSy, ROSm, ROSc, and ROSo, developing units Gy, Gm, Gc, and Go, first transfer rollers T1*y*, T1*m*, T1*c*, and T1*o*, and photoconductor cleaners CLy, CLm, CLc, and CLo are also disposed around the other photoconductors Py, Pm, Pc, and Po, respectively.

Toner cartridges Ky, Km, Kc, Kk, and Ko, which are an example of a container and contain developer to be supplied to the developing units Gy to Go, respectively, are detachably supported above the marking section U1*a*.

An intermediate transfer belt B, which is an example of an intermediate transfer body and an example of an image carrier, is disposed below the photoconductors Py to Po. The intermediate transfer belt B is sandwiched between the photoconductors Py to Po and the first transfer rollers T1*y* to T1*o*. The back surface of the intermediate transfer belt B is supported by a driving roller Rd as an example of driving member, a tension roller Rt as an example of a tension applying member, a walking roller Rw as an example of a meander preventing member, multiple idler rollers Rf as an example of a driven member, a backup roller T2*a* as an example of an opposed member used for second transfer, multiple retract rollers R1 as an example of a movable member, and the first transfer rollers T1*y* to T1*o*.

On the front surface of the intermediate transfer belt B, a belt cleaner CLB as an example of an intermediate transfer body cleaner is disposed near the driving roller Rd.

A second transfer roller T2*b* as an example of a second transfer member is disposed so as to be opposed to the backup roller T2*a*, with the intermediate transfer belt B therebetween. A contact roller T2*c* as an example of a contact member is in contact with the backup roller T2*a* to apply a voltage of a polarity opposite to the polarity of charge on the developer to the backup roller T2*a*. A transport belt T2*e* as an example of a transport member is tightly stretched between the second transfer roller T2*b* according to Exemplary Embodiment 1, and a driving roller T2*d* as an example of a driving member disposed below and to the right of the transport belt T2.

The backup roller T2*a*, the second transfer roller T2*b*, and the contact roller T2*c* constitute a second transfer unit T2 as an example of a transfer unit. The first transfer rollers T1*y* to T1*o*, the intermediate transfer belt B, the second transfer unit T2, and the like constitute transfer devices T1, B, and T2 according to Exemplary Embodiment 1.

Paper feed trays TR1 and TR2, which are an example of an accommodating section that accommodates a recording sheet S as an example of a medium, are provided below the second transfer unit T2. A pickup roller Rp as an example of an ejection member, and a handling roller Rs as an example of a handling member are disposed diagonally above and to the right of each of the paper feed trays TR1 and TR2. A transport path SH on which the recording sheet S is transported extends from the handling roller Rs. Multiple transport rollers Ra, which are an example of a transport member that transports the recording sheet S to the downstream side, are disposed along the transport path SH.

A deburring device Bt as an example of an unnecessary-portion removing device is disposed downstream of the position where the transport paths SH from the two paper feed trays TR1 and TR2 join together in the transport direction of the recording sheet S. The deburring device Bt nips the recording sheet S with a preset pressure and transports the recording sheet S to the downstream side to thereby perform so-called deburring, that is, removal of an unnecessary portion at the edges of the recording sheet S.

A double-feeding detection device Jk is disposed downstream of the deburring device Bt. The double-feeding detection device Jk measures the thickness of the recording sheet S passing through the detection device Jk to detect so-called double feeding, that is, a state in which multiple recording sheets S are lying on top of each other. A correction roller Rc as an example of an orientation correcting device is disposed downstream of the double-feeding detection device Jk. The correction roller Rc corrects so-called skew, that is, a slant with respect to the transport direction of the recording sheet S. A registration roller Rr is disposed downstream of the correction roller Rc. The registration roller Rr is an example of a regulating member that regulates the timing at which to transport the recording sheet S to the second transfer unit T2.

The feeder unit U2 is also provided with components such as paper feed trays TR3 and TR4 which are similar to the paper feed trays TR1 and TR2, the pickup roller Rp, the handling roller Rs, and the transport roller Ra mentioned above. The transport path SH from each of the paper feed trays TR3 and TR4 joins the transport path SH in the printer body U1 at a position upstream of the double-feeding detection device Jk.

Multiple transport belts HB as an example of a medium transport device are disposed downstream of the transport belt T2*e* in the transport direction of the recording sheet S.

A fixing device F is disposed downstream of the transport belt HB in the transport direction of the recording sheet S.

A cooling device Co that cools the recording sheet S is disposed downstream of the fixing device F.

A de-curler Hd, which applies pressure to the recording sheet S to correct so-called curling, that is, curving of the recording sheet S, is disposed downstream of the cooling device Co.

An image reading device Sc, which reads an image recorded on the recording sheet S, is disposed downstream of the de-curler Hd.

A reversing path SH2 is provided downstream of the image reading device Sc. The reversing path SH2 is an example of a transport path that branches out from the transport path SH extending toward the interface module U4. A first gate GT1 as an example of a transport direction switching member is disposed at the branching point of the reversing path SH2.

Multiple switchback rollers Rb, which are an example of a transport member capable of rotating in forward and reverse directions, are disposed in the reversing path SH2. A connection path SH3 is provided upstream of the switchback roller Rb. The connection path SH3 is an example of a transport path that branches out from an upstream portion of the reversing path SH2 and joins the transport path SH at a position downstream of the branching point between the transport path SH and the reversing path SH2. A second gate GT2 as an example of a transport direction switching member is disposed at the branching point between the reversing path SH2 and the connection path SH3.

A return path SH4 for performing so-called switchback, that is, reversal of the transport direction of the recording sheet S, is disposed downstream of the reversing path SH2, below the cooling device Co. The switchback roller Rb an example of a transport member capable of rotating in forward and reverse directions is disposed in the return path SH4. A third gate GT3 as an example of a transport direction switching member is disposed at the entrance of the return path SH4.

The transport path SH on the downstream side of the return path SH4 joins the transport path SH extending from each of the paper feed trays TR1 and TR2.

The interface module U4 is provided with the transport path SH extending toward the discharge unit U3.

A stacker tray TR is disposed in the discharge unit U3. The stacker tray TR is an example of a loading container on which to load the recording sheet S that has been discharged. The discharge unit U3 is provided with a discharge path SH5 that branches out from the transport path SH and extends toward the stacker tray TRh. The transport path SH according to Exemplary Embodiment 1 is provided in such a way that, when an additional discharge unit or post-processing device (not illustrated) are additionally mounted to the right of the discharge unit U3, the recording sheet S can be transported to the added unit or device.

(Marking Operation)

The printer U starts an image forming operation as a job upon receiving image information transmitted from the personal computer PC via the print image server COM. When a job is started, components such as the photoconductors Py to Po and the intermediate transfer belt B rotate.

The photoconductors Py to Po are rotationally driven by a drive source (not illustrated).

In the charging units CCy to CCo, a preset voltage is applied to electrically charge the surface of the photoconductors Py to P.

The exposure devices ROSy to ROSo output laser beams Ly, Lm, Lc, Lk, and Lo, which are an example of a beam of light for writing a latent image, in accordance with a control signal from the controller C, thereby writing an electrostatic latent image on the charged surface of the photoconductors Py to Po.

The developing units Gy to Go develop the electrostatic latent image on the surface of the photoconductors Py to Po into a visible image.

The toner cartridges Ky to Ko add developer as developer is consumed by development in the developing units Gy to Go.

The first transfer rollers T1*y* to T1*o*, to which a first transfer voltage of a polarity opposite to the polarity of charge on the developer is applied, transfers a visible image on the surface of the photoconductors Py to Po to the surface of the intermediate transfer belt B.

The photoconductor cleaners CLy to CLo clean away developer remaining on the surface of the photoconductors Py to Po after first transfer.

As the intermediate transfer belt B passes through a first transfer region located opposite to the photoconductors Py to Po, images are transferred to the intermediate transfer belt B and laid upon each other in the order of O, Y, M, C, and K, which then pass through a second transfer region Q4 located opposite to the second transfer unit T2. In the case of a single-color image, an image of only one color is transferred and sent to the second transfer region Q4.

The pickup roller Rp sends out recording sheets S from each of the paper feed trays TR1 to TR4 from which the recording sheets S are to be supplied, in accordance with the size of image information received and the type of the recording sheet S specified, and the size, type, and the like of the recording sheet S accommodated.

The handling roller Rs handles the recording sheets S sent out from the pickup roller Rp by separating the recording sheets S one by one.

The deburring device Bt removes burrs by applying a preset pressure to the recording sheet S passing through the deburring device Bt.

The double-feeding detection device Jk detects double feeding of the recording sheet S by detecting the thickness of the recording sheet S passing through the double-feeding detection device Jk.

The correction roller Rc corrects skew by bringing the recording sheet S passing through the correction roller Rc into contact with a wall surface (not illustrated).

The registration roller Rr sends out the recording sheet S in synchronism with the timing when an image on the surface of the intermediate transfer belt B is sent to the second transfer region Q4.

In the second transfer unit T2, a preset second transfer voltage of the same polarity as the polarity of charge on the developer is applied to the backup roller T2*a* via the contact roller T2*c*, thus transferring an image on the intermediate transfer belt B to the recording sheet S.

The belt cleaner CLB cleans away developer that remains on the surface of the intermediate transfer belt B after an image on the intermediate transfer belt B is transferred in the second transfer region Q4.

The transport belts T2*e* and HB hold, on their surface, the recording sheet S to which an image has been transferred in the second transfer unit T2, and transports this recording sheet S to the downstream side.

The fixing device F has a heat roller Fh as an example of a heat application member, and a pressure roller Fp as an example of a pressure application member. A heater as an example of a heat source is accommodated inside the heat roller Fh. The fixing device F applies heat and pressure to the recording sheet S passing through the contact region between the heat roller Fh and the pressure roller Fp, thereby fixing an unfixed image on the surface of the recording sheet S to the sheet S.

The cooling device Co cools the recording sheet S heated by the fixing device F.

The de-curler Hd applies pressure to the recording sheet S that has passed through the cooling device Co to remove so-called curling, that is, curving of the recording sheet S.

The image reading device Sc reads an image on the surface of the recording sheet S that has passed through the de-curler Hd.

In the case of performing duplex printing, the first gate GT1 activates so that the recording sheet S that has passed through the de-curler Hd is transported to the reversing path SH2, and after being switched back in the return path SH4, the recording sheet S is then sent through the transport path SH to the registration roller Rr again for printing on the second side of the recording sheet S.

The recording sheet S to be discharged to the discharge unit U3 is transported on the transport path SH, and discharged to the stacker tray TRh. At this time, in a case where the recording sheet S is to be discharged to the stacker tray TRh with the front and back sides reversed, the recording sheet S is temporarily transported from the transport path SH into the reversing path SH2, and after the trailing end in the transport direction of the recording sheet S passes through the second gate GT2, the second gate GT2 is switched so that the switchback roller Rb rotates in the reverse direction, which causes the recording sheet S to be transported through the connection path SH3 to the stacker tray TRh.

The recording sheet S is loaded on the stacker tray TRh, with a loading plate TRh1 automatically moving up and down to bring its top surface at a preset level in accordance with the amount of recording sheets S loaded.

(Description of Transfer Device)

Figure 3:
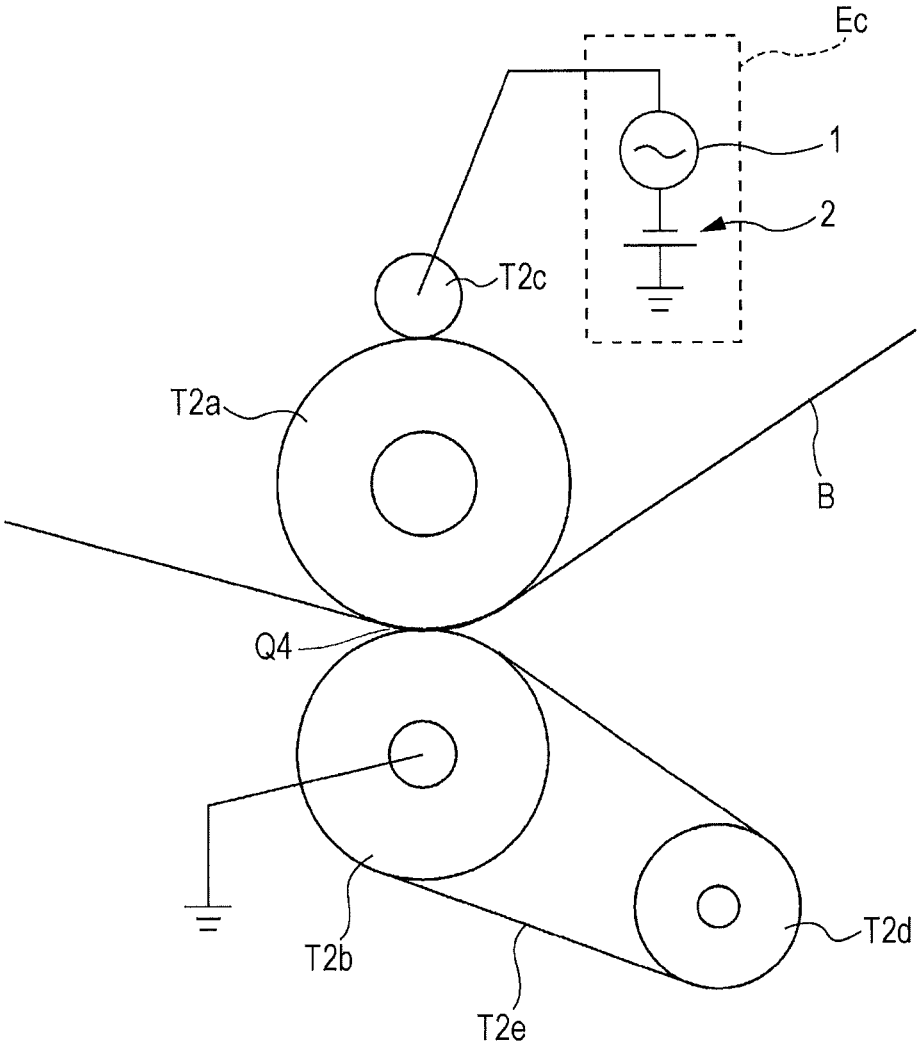
FIG. 3 illustrates major portions of a transfer device according to Exemplary Embodiment 1.

FIG. 3 illustrates major portions of a transfer device according to Exemplary Embodiment 1.

In FIG. 3, in the second transfer unit T2 as an example of a transfer member according to Exemplary Embodiment 1, a power supply circuit for transfer Ec has an AC voltage circuit 1, and a DC voltage circuit 2. The AC voltage circuit 1 and the DC voltage circuit 2 are connected in series. The second transfer bias as an example of a transfer bias is applied to the contact roller T2*c*. The second transfer voltage according to Exemplary Embodiment 1 is generated by superimposing an AC voltage as an example of an AC bias, and a DC voltage as an example of a DC bias on each other.

The AC voltage circuit 1 according to Exemplary Embodiment 1 is capable of changing the amplitude between the maximum and minimum values, or so-called peak-to-peak voltage Vpp, of an AC voltage and a frequency. The DC voltage circuit 2 according to Exemplary Embodiment 1 is capable of changing a DC voltage value Vdc.

(Description of Controller According to Exemplary Embodiment 2)

Figure 4:
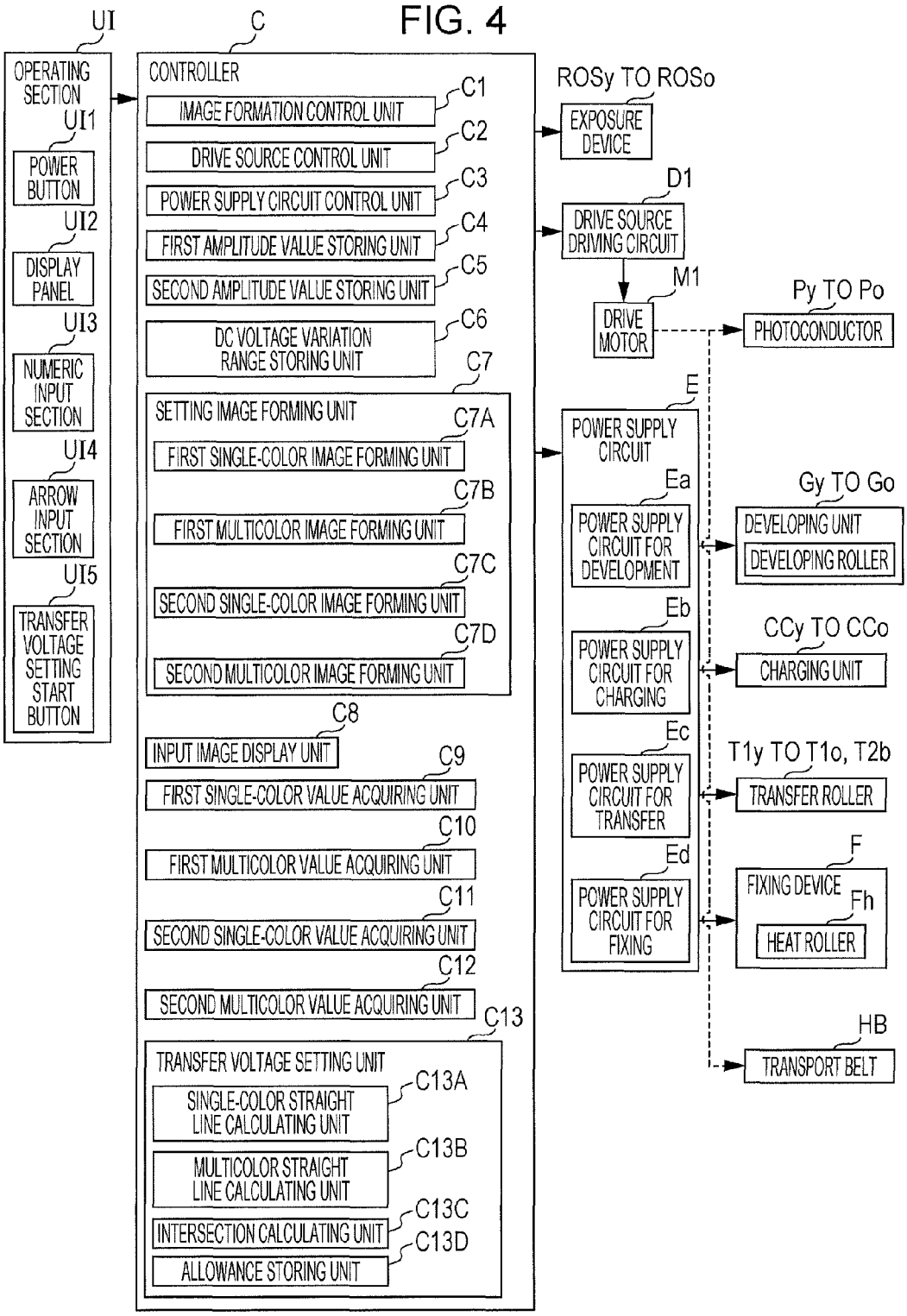
FIG. 4 is a block diagram of various functions included in a controller of the image forming apparatus according to Exemplary Embodiment 1.

FIG. 4 is a block diagram illustrating various functions included in a controller of the image forming apparatus according to Exemplary Embodiment 1.

In FIG. 4, the controller C of the printer body U1 has an input/output interface I/O for inputting or outputting a signal from or to the outside. Further, the controller C has a read only memory (ROM) in which a program, information, and the like for performing necessary processing are stored. Further, the controller C has a random access memory (RAM) for temporarily storing necessary data. Further, the controller C has a central processing unit (CPU) that executes processing according to a program stored in the ROM or the like. Accordingly, the controller C according to Exemplary Embodiment 1 is implemented by a miniature information processor, that is, a so-called microcomputer. Therefore, the controller C is able to realize various functions by executing a program stored in the ROM or the like.

(Signal Output Elements Connected to Controller C of Printer Body U1)

The controller C of the printer body U1 receives an input of output signals from signal output elements such as the operating section UI and the image reading device Sc.

The operating section UI includes components such as a power button UI1 as an example of a power turn-on section, a display panel UI2 as an example of a display, a numeric input section UI3 as an example of an input section, an arrow input section UI4, and a transfer voltage setting start button UI5 as an example of an input member for starting setting of a transfer voltage.

(Controlled Elements Connected to Controller C of Printer Body U1)

The controller C of the printer body U1 is connected to a drive source driving circuit D1, the power supply circuit E, and other controlled elements (not illustrated). The controller C outputs control signals to the corresponding circuits D1, E, and the like.

D1: Drive Source Driving Circuit

The drive source driving circuit D1 rotationally drives components such as the photoconductor drums Py to Po and the intermediate transfer belt B via a drive motor M1 as an example of a drive source.

E: Power Supply Circuit

The power supply circuit E has components such as a power supply circuit for development Ea, a power supply circuit for charging Eb, a power supply circuit for transfer Ec, and a power supply circuit for fixing Ed.

Ea: Power Supply Circuit for Development

The power supply circuit for development Ea applies a developing voltage to each of the developing rollers of the developing units Gy to Go.

Eb: Power Supply Circuit for Charging

The power supply circuit for charging Eb applies a charging voltage for charging the surfaces of the photoconductor drums Py to Po to the charging units CCy to CCo, respectively.

Ec: Power Supply Circuit for Transfer

The power supply circuit for transfer Ec applies a transfer voltage to each of the first transfer rollers T1*y* to T1*o* and the second transfer roller T2*b*.

Ed: Power Supply Circuit for Fixing

The power supply circuit for fixing Ed supplies the heat roller Fh of the fixing device F with electric power for heating by a heater.

(Functions of Controller C of Printer Body U1)

The controller C of the printer body U1 has the function of executing processing according to signals input from the signal output elements, and outputting control signals to the controlled elements. That is, the controller C includes the following functions.

C1: Image Formation Control Unit

The image formation control unit C1 controls, for example, driving of various components of the printer U and the application timing of various voltages in accordance with image information input from the personal computer PC, thereby executing an image forming operation as a job.

C2: Drive Source Control Unit

The drive source control unit C2 controls the drive of the drive motor M1 via the drive source driving circuit D1, thereby controlling the drive of components such as the photoconductor drums Py to Po.

C3: Power Supply Control Unit

The power supply control unit C3 controls the power supply circuits Ea to Ed to thereby control voltages applied to various components and electric power supplied to various components. That is, the power supply control unit C3 according to Exemplary Embodiment 1 controls the power supply circuit for transfer Ec to also control the transfer voltage that is applied to the second transfer roller T2*b* via the contact roller T2*c*.

C4: First Amplitude Value Storing Unit

A first amplitude value storing unit C4 stores a first amplitude value Vpp1 as an example of a first fixed value of amplitude which is used to set the second transfer voltage. As the first amplitude value Vpp1, the first amplitude value storing unit C4 according to Exemplary Embodiment 1 stores, for example, Vpp1=12 [kV].

C5: Second Amplitude Value Storing Unit

A second amplitude value storing unit C5 stores a second amplitude value Vpp2 as an example of a second fixed value of amplitude which is used to set the second transfer voltage. As the second amplitude value Vpp2 different from the second amplitude value Vpp1, the second amplitude value storing unit C5 according to Exemplary Embodiment 1 stores, for example, Vpp2=7 [kV].

C6: DC Voltage Variation Range Storing Unit

A DC voltage variation range storing unit C6 stores a range within which the DC voltage value is varied in setting the second transfer voltage. The DC voltage variation range storing unit C6 according to Exemplary Embodiment 1 stores a range of −1.5 [kV] to −3.5 [kV] as a range within which a DC voltage value Vdc is varied in steps of 0.1 [kV]. That is, in Exemplary Embodiment 1, the DC voltage value Vdc is varied in twenty-one steps.

Figure 5:
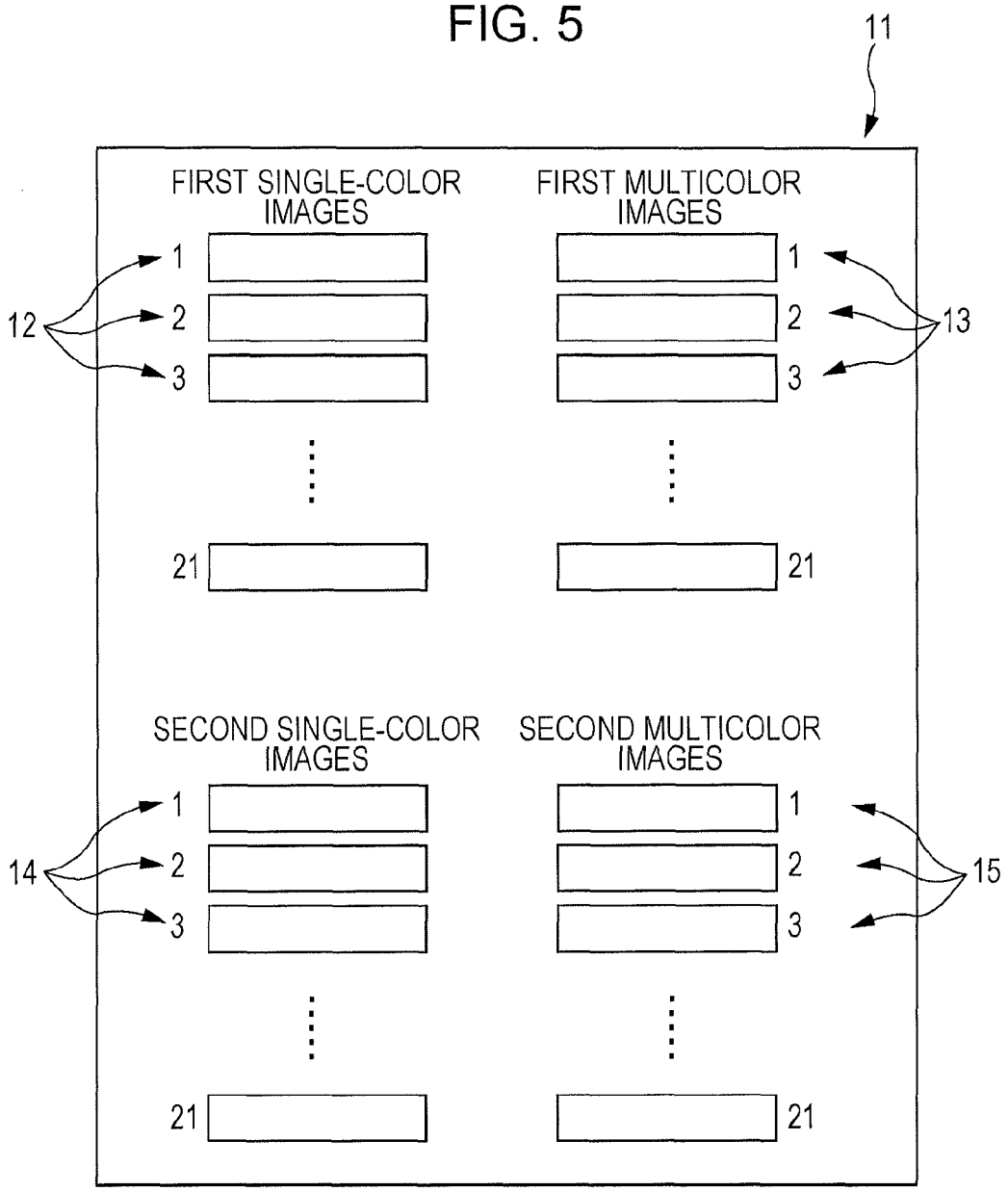
FIG. 5 illustrates an image used for setting a transfer voltage according to Exemplary Embodiment 1.

FIG. 5 illustrates an image used for setting a transfer voltage according to Exemplary Embodiment 1.

C7: Setting Image Forming Unit

A setting image forming unit C7 has a first single-color image forming unit C7A, a first multicolor image forming unit C7B, a second single-color image forming unit C7C, and a second multicolor image forming unit C7D. The setting image forming unit C7 forms a setting image 11, which is used for setting a second transfer voltage, on the recording sheet S. In FIG. 5, the setting image 11 according to Exemplary Embodiment 1 has twenty-one first single-color images 12 as an example of a first single-color image, twenty-one first multicolor images 13 as an example of a first multicolor image, twenty-one second single-color images 14 as an example of a second single-color image, and twenty-one second multicolor images 15 as an example of a second multicolor image. The images 12 to 15 are rectangular images extending in the width direction of the recording sheet S. The rectangular images are formed at preset intervals along the transport direction of the recording sheet S. In Exemplary Embodiment 1, the first single-color image 12 and the second single-color image 14 are each a single-color image printed by using only the color K. The first multicolor image 13 and the second multicolor image 15 are each a multicolor image formed by using toners of the colors Y, M, C, and K and the color O (transparent).

The first single-color image 12 and the first multicolor image 13 constitute a first image 12+13 according to Exemplary Embodiment 1, and the second single-color image 14 and the second multicolor image 15 constitute a second image 14+15 according to Exemplary Embodiment 1.

C7A: First Single-Color Image Forming Unit

The first single-color image forming unit C7A forms the first single-color image 12 every time when a DC voltage Vdc is changed, in a case where an AC voltage with the first amplitude value Vpp1, and the DC voltage Vdc are superimposed on each other and applied to the backup roller T2*a*. In the first single-color image forming unit C7A according to Exemplary Embodiment 1, an image formed when the DC voltage Vdc is −1.5 kV corresponds to the first image as counted from the upstream side in the transport direction, an image formed when the DC voltage Vdc is −1.6 kV corresponds to the second image as counted from the upstream side in the transport direction, an image formed when the DC voltage Vdc is −1.7 kV corresponds to the third image as counted from the upstream side in the transport direction, and so on, with an image formed when the DC voltage Vdc is −3.5 kV corresponding to the twenty-first image.

C7B: First Multicolor Image Forming Unit

The first multicolor image forming unit C7B forms the first multicolor image 13 every time when a DC voltage Vdc is changed, in a case where an AC voltage with the first amplitude value Vpp1, and the DC voltage Vdc are superimposed on each other. The first multicolor image forming unit C7B according to Exemplary Embodiment 1 forms the first multicolor image 13 so as to be adjacent to the first single-color image 12 in the width direction. Therefore, like the first single-color image 12, an image formed when the DC voltage Vdc is −1.5 kV and an image formed when the DC voltage Vdc is −3.5 kV are the first and twenty-first images, respectively, as counted from the upstream side in the transport direction.

C7C: Second Single-Color Image Forming Unit

The second single-color image forming unit C7C forms the second single-color image 14 every time when a DC voltage Vdc is changed, in a case where an AC voltage with the second amplitude value Vpp2, and the DC voltage Vdc are superimposed on each other and applied to the backup roller T2*a*. The second single-color image forming unit C7C according to Exemplary Embodiment 1 forms the second single-color image 14 at a position subsequent to and downstream of the first single-color image 12 in the transport direction. Like the first single-color image 12, the second single-color image 14 is formed so that an image formed when the DC voltage Vdc is −1.5 kV and an image formed when the DC voltage Vdc is −3.5 kV are the first and twenty-first images, respectively, as counted from the upstream side in the transport direction.

C7D: Second Multicolor Image Forming Unit

The second multicolor image forming unit C7D forms the second multicolor image 15 every time when a DC voltage Vdc is changed, in a case where an AC voltage with the second amplitude value Vpp2, and the DC voltage Vdc are superimposed on each other. The second multicolor image forming unit C7D according to Exemplary Embodiment 1 forms the second multicolor image 15 so as to be adjacent to the second single-color image 14 in the width direction, and at a position subsequent to and downstream of the first multicolor image 13 in the transport direction. Therefore, like the second single-color image 14, the second multicolor image 15 is also formed so that an image formed when the DC voltage Vdc is −1.5 kV and an image formed when the DC voltage Vdc is −3.5 kV are the first and twenty-first images, respectively, as counted from the upstream side in the transport direction.

Figure 6:
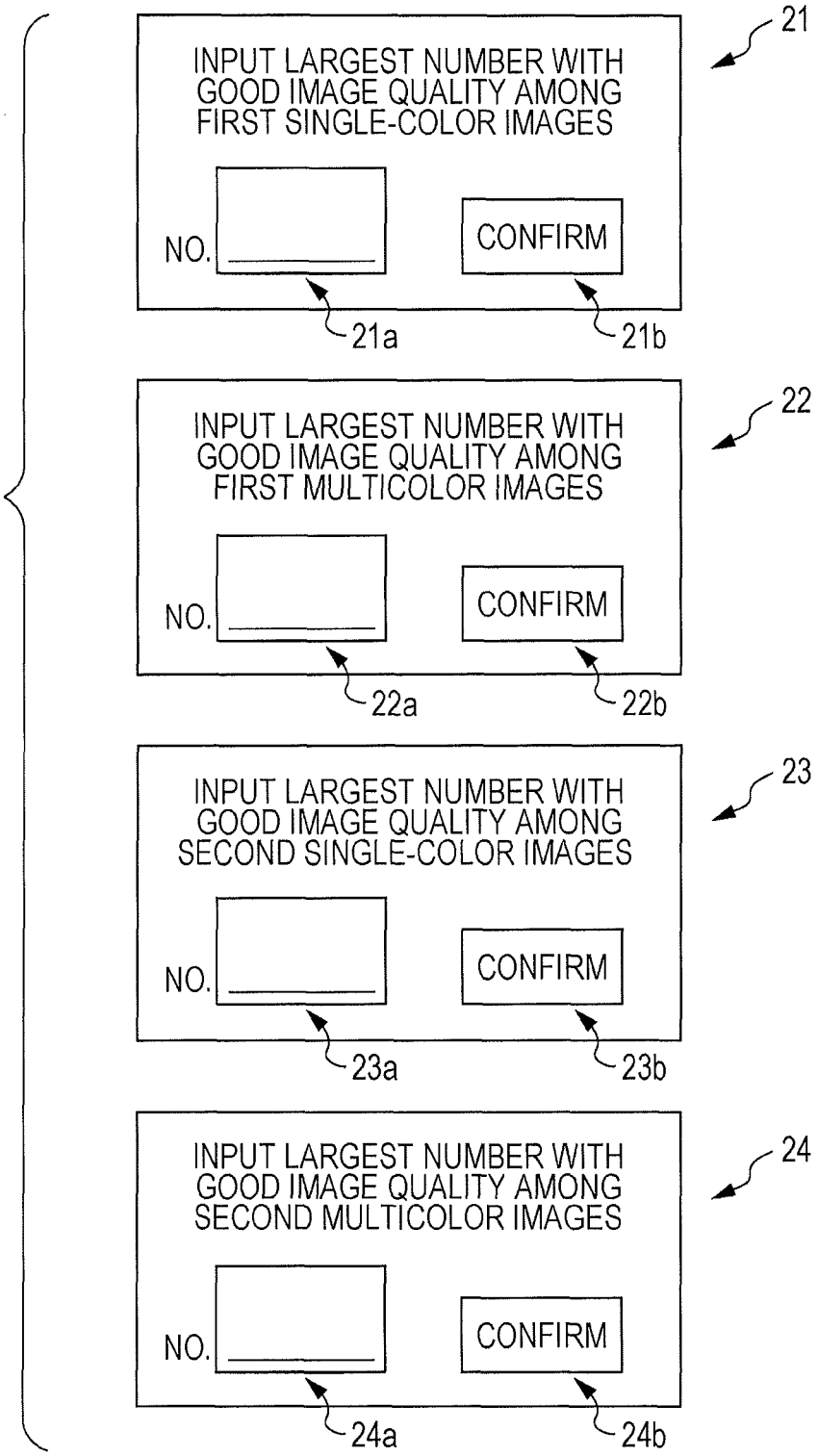
FIG. 6 illustrates input images according to Exemplary Embodiment 1.

FIG. 6 illustrates input images according to Exemplary Embodiment 1.

C8: Input Image Display Unit

An input image display unit C8 displays input images 21 to 24 on the display panel UI2 when the second transfer voltage is to be set. In FIG. 6, the input images 21 to 24 according to Exemplary Embodiment 1 have number input fields 21*a* to 24*a*, and Confirm buttons 21*b* to 24*b*. In Exemplary Embodiment 1, when the setting image 11 is printed, the input image 21 used for inputting the first single-color image 12 is displayed on the display panel UI2. Then, when the Confirm button 21*b* is entered from the input image 21 used for inputting a first single-color image, the input image 22 used for inputting a first multicolor image is displayed. Likewise, the display sequentially transitions to the input image 23 used for inputting a second single-color image and then to the input image 24 used for inputting a second multicolor image.

C9: First Single-Color Value Acquiring Unit

A first single-color value acquiring unit C9 acquires, from the multiple first single-color images 12 formed by the first single-color image forming unit C7A, a first single-color value (Vdc1, Vpp1) as an example of first information which has an amplitude value Vpp1 and a DC voltage value Vdc1 corresponding to the first single-color image 12 whose image quality is at the acceptable limit. When a numeric value representing the first single-color image 12 whose image quality is at the acceptable limit is input from the input image 21 used for inputting a first single-color image, the first single-color value acquiring unit C9 according to Exemplary Embodiment 1 acquires a first single-color value (Vdc1, Vpp1) corresponding to the input numeric value. For example, when "8" is input from the input image 21, the first single-color value acquiring unit C9 acquires a first single-color value (Vdc1, Vpp1) whose DC voltage value Vdc1 is −2.2 kV that corresponds to the eighth largest DC voltage value Vdc, and whose amplitude value Vpp1 is the first amplitude value of 12 kV.

C10: First Multicolor Value Acquiring Unit

A first multicolor value acquiring unit C10 acquires, from the multiple first multicolor images 13 formed by the first multicolor image forming unit C7B, a first multicolor value (Vdc2, Vpp1) as an example of first information which has an amplitude value Vpp1 and a DC voltage value Vdc2 corresponding to the first multicolor image 13 whose image quality is at the acceptable limit. Like the first single-color value acquiring unit C9, the first multicolor value acquiring unit C10 according to Exemplary Embodiment 1 acquires a first multicolor value (Vdc2, Vpp1) corresponding to a numeric value input from the input image 22.

C11: Second Single-Color Value Acquiring Unit

A second single-color value acquiring unit C11 acquires, from the multiple second single-color images 14 formed by the second single-color image forming unit C7C, a second single-color value (Vdc3, Vpp2) as an example of second information which has an amplitude value Vpp2 and a DC voltage value Vdc3 corresponding to the second single-color image 14 whose image quality is at the acceptable limit. Like the first single-color value acquiring unit C9, the second multicolor value acquiring unit C11 according to Exemplary Embodiment 1 acquires a second multicolor value (Vdc3, Vpp2) corresponding to a numeric value input from the input image 23.

C12: Second Multicolor Value Acquiring Unit

A second multicolor value acquiring unit C12 acquires, from the multiple second multicolor images 15 formed by the second multicolor image forming unit C7D, a second multicolor value (Vdc4, Vpp2) as an example of second information which has an amplitude value Vpp2 and a DC voltage value Vdc4 corresponding to the second multicolor image 15 whose image quality is at the acceptable limit. Like the first single-color value acquiring unit C9, the second multicolor value acquiring unit C12 according to Exemplary Embodiment 1 acquires a second multicolor value (Vdc4, Vpp2) corresponding to a numeric value input from the input image 24.

Figure 7:
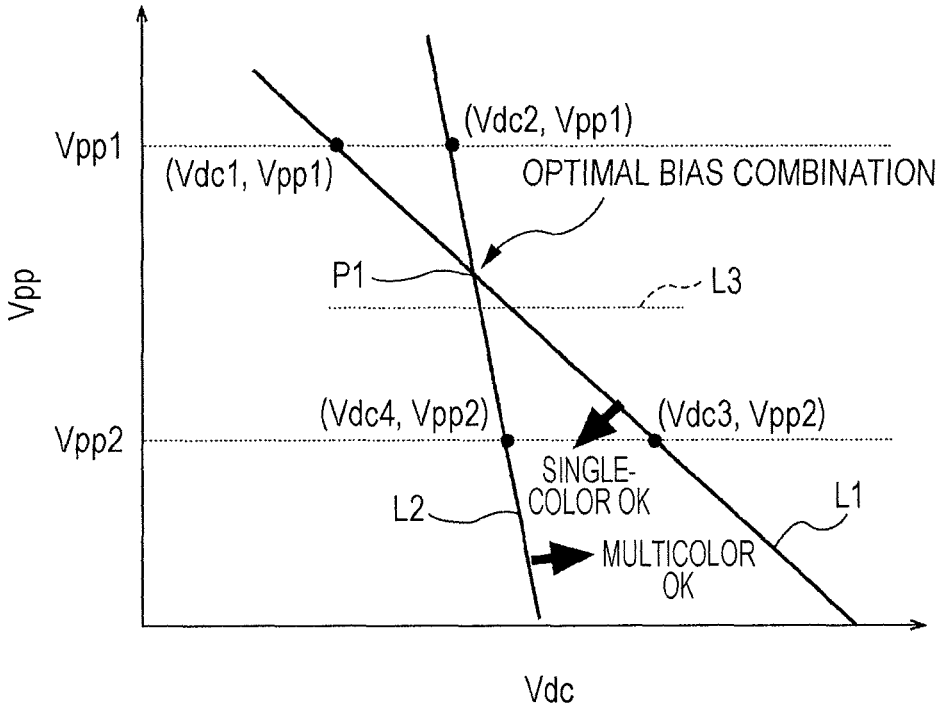
FIG. 7 illustrates a transfer voltage setting method according to Exemplary Embodiment 1.

FIG. 7 illustrates a transfer voltage setting method according to Exemplary Embodiment 1.

C13: Transfer Voltage Setting Unit

A transfer voltage setting unit C13 has a single-color straight line calculating unit C13A, a multicolor straight line calculating unit C13B, an intersection calculating unit C13C, and an allowance storing unit C13D. The transfer voltage setting unit C13 sets a second transfer voltage applied to the second transfer unit T2 as an example of a transfer voltage. The transfer voltage setting unit C13 according to Exemplary Embodiment 1 sets the peak-to-peak voltage value Vpp of an AC voltage, and a DC voltage value Vdc of the second transfer voltage. That is, the transfer voltage setting unit C13 sets the peak-to-peak voltage value Vpp associated with the waveform shape of an AC bias, and the DC bias value Vdc.

C13A: Single-Color Straight Line Calculating Unit

The single-color straight line calculating unit C13A calculates a single-color straight line L1 on the basis of the first single-color value (Vdc1, Vpp1) and the second single-color value (Vdc3, Vpp2). The single-color straight line calculating unit C13A according to Exemplary Embodiment 1 calculates the single-color straight line L1 as a straight line passing through two points corresponding to the first single-color value (Vdc1, Vpp1) and the second single-color value (Vdc3, Vpp2). In Exemplary Embodiment 1, the single-color straight line L1 is calculated as L1: $Y=\{(Vpp1-Vpp2)/(Vdc1-Vdc3)\}(X-Vdc1)+Vpp1$, on a graph with the DC voltage value taken along the horizontal axis (X-axis) and the peak-to-peak voltage value taken along the vertical axis (Y-axis).

C13B: Multicolor Straight Line Calculating Unit

The multicolor straight line calculating unit C13B calculates a multicolor straight line L2 on the basis of the first multicolor value (Vdc2, Vpp1) and the second multicolor value (Vdc4, Vpp2). The multicolor straight line calculating unit C13B according to Exemplary Embodiment 1 calculates the multicolor straight line L2 as a straight line passing through two points corresponding to the first multicolor value (Vdc2, Vpp1) and the second multicolor value (Vdc4, Vpp2). In Exemplary Embodiment 1, the multicolor straight line L2 is calculated as L2: $Y=\{(Vpp1-Vpp2)/(Vdc2-Vdc4)\}(X-Vdc2)+Vpp1$, on a graph with the DC voltage value taken along the horizontal axis (X-axis) and the peak-to-peak voltage value taken along the vertical axis (Y-axis).

C13C: Intersection Calculating Unit

The intersection calculating unit C13C calculates the intersection P1 (Vdc5, Vpp5) of the single-color straight line L1 and the multicolor straight line L2.

C13D: Allowance Storing Unit

The allowance storing unit C13D stores a margin as an example of an allowance to be made when setting a second transfer voltage. In Exemplary Embodiment 1, since the voltage is varied in steps of 0.1 kV in the setting image 11, it is considered that an optimal bias can be determined within a precision error of 0.1 kV, and thus "−0.1 kVpp from the intersection P1" is stored as an example of the margin L3.

Accordingly, in the transfer voltage setting unit C13 according to Exemplary Embodiment 1, the intersection P1 is calculated by the intersection calculating unit C13C from the single-color straight line L1 calculated by the single-color straight line calculating unit C13A and the multicolor straight line L2 calculated by the multicolor straight line calculating unit C13B, and the second transfer voltage is set by taking the margin L3 into account. In Exemplary Embodiment 1, for example, when the power supply circuit E is able to set the DC voltage value Vdc and the peak-to-peak voltage value Vpp in steps of 0.1 kV, as illustrated in FIG. 7, for example, by using the value of the intersection P1, Vdc5 is rounded up to the first decimal place, and Vpp5 is rounded down to the first decimal place, and if the value obtained as a result falls within the range bounded by the three straight lines L1 to L3, then the value is set as the second transfer voltage. If the above value does not fall within the range bounded by the three straight lines L1 to L3, it is determined whether a value obtained by adding 0.1 kV to the rounded-up value of Vdc5, or a value obtained by subtracting 0.1 kV from the rounded-down value of Vpp5 falls within the range bounded by the three straight lines L1 to L3, and if the value does not fall within this range, the same process is repeated to set the second transfer voltage.

(Description of Flowchart According to Exemplary Embodiment 1)

Next, the flow of control in the printer U according to Exemplary Embodiment 1 will be described with reference to a so-called flowchart.

(Description of Flowchart of Transfer Voltage Setting Process)

Figure 8:
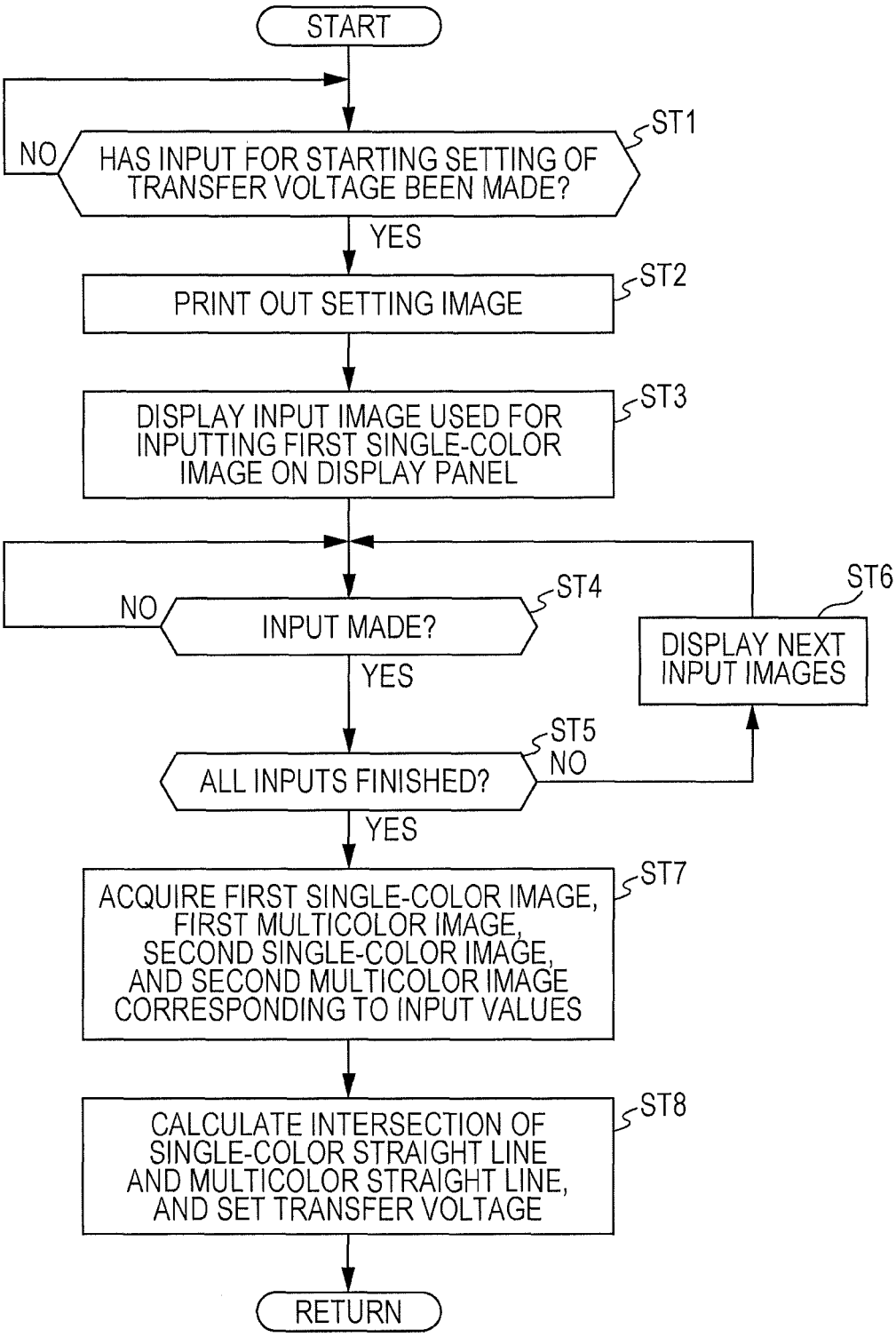
FIG. 8 is a flowchart of a transfer voltage setting process according to Exemplary Embodiment 1.

FIG. 8 is a flowchart of a transfer voltage setting process according to Exemplary Embodiment 1.

The processing in each of steps ST in the flowchart of FIG. 8 is executed in accordance with a program stored in the controller C of the printer U. Further, this processing is executed in parallel with various other kinds of processing executed in the printer U.

The flowchart illustrated in FIG. 8 is started upon turning on power to the printer U.

In ST1 illustrated in FIG. 8, it is determined if an input for starting a transfer voltage setting process has been started, that is, if the transfer voltage setting start button UI5 has been entered. If Yes (Y), the processing proceeds to ST2. If No (N), ST1 is repeated.

In ST2, the setting image 11 is printed out. Then, the processing proceeds to ST3.

In ST3, the input image 21 is displayed on the display panel UI2. Then, the processing proceeds to ST4.

In ST4, it is determined if an input for confirming entry has been made in each of the input images 21 to 24. If Yes (Y), the processing proceeds to ST5, and if No (N), ST4 is repeated.

In ST5, it is determined if all the numeric values each representing an image whose image quality is at the acceptable limit have been input, that is, if an input of the corresponding numeric value has been made from the input image 24 used for inputting a second multicolor image. If No (N), the processing proceeds to ST6, and if Yes (Y), the processing proceeds to ST7.

In ST6, the next input images 22 to 24 are displayed on the display panel UI2. Then, the processing returns to ST4.

In ST7, the first single-color value (Vdc1, Vpp1), the first multicolor value (Vdc2, Vpp1), the second single-color value (Vdc3, Vpp2), and the second multicolor value (Vdc4, Vpp2) corresponding to the input images 21 to 24 are acquired. Then, the processing proceeds to ST8.

In ST8, the intersection P1 of the single-color straight line L1 and the multicolor straight line L2 is calculated, and the second transfer voltage is set. Then, the processing returns to ST1.

(Function of Transfer Voltage Setting Process According to Exemplary Embodiment 1)

In the printer U according to Exemplary Embodiment 1 described above, when a second transfer voltage setting process is started, the first single-color value (Vdc1, Vpp1), the first multicolor value (Vdc2, Vpp1), the second single-color value (Vdc3, Vpp2), and the second multicolor value (Vdc4, Vpp2) are acquired in accordance with values input on the basis of the setting image 11 that has been printed. Then, a second transfer voltage is set on the basis of the intersection P1 of the single-color straight line L1 and the multicolor straight line L2.

In the case of printing on a medium with many surface asperities such as Japanese paper or embossed paper, when printing in single color, the thickness of the toner layer is small, and thus the electrical resistance of the toner layer is small in comparison to multicolor printing in which four colors of toner are combined in a layered fashion. Therefore, on the side farther away from the origin of the graph than the single-color straight line L1, that is, as the voltage becomes higher, electric discharge becomes more liable to occur, which increases the risk of image defects caused by electric discharge.

In the case of printing in multiple colors, the toner layer has a large thickness, which means that a large amount of toner is to be transferred. Therefore, on the side closer to the origin of the graph than the multicolor straight line L2, that is, at lower transfer voltages, an insufficient density can result from insufficient transfer. Therefore, it is necessary to set the transfer voltage within a region closer to the origin than the single-color straight line L1 and farther away from the origin than the multicolor straight line L2.

Figure 9:
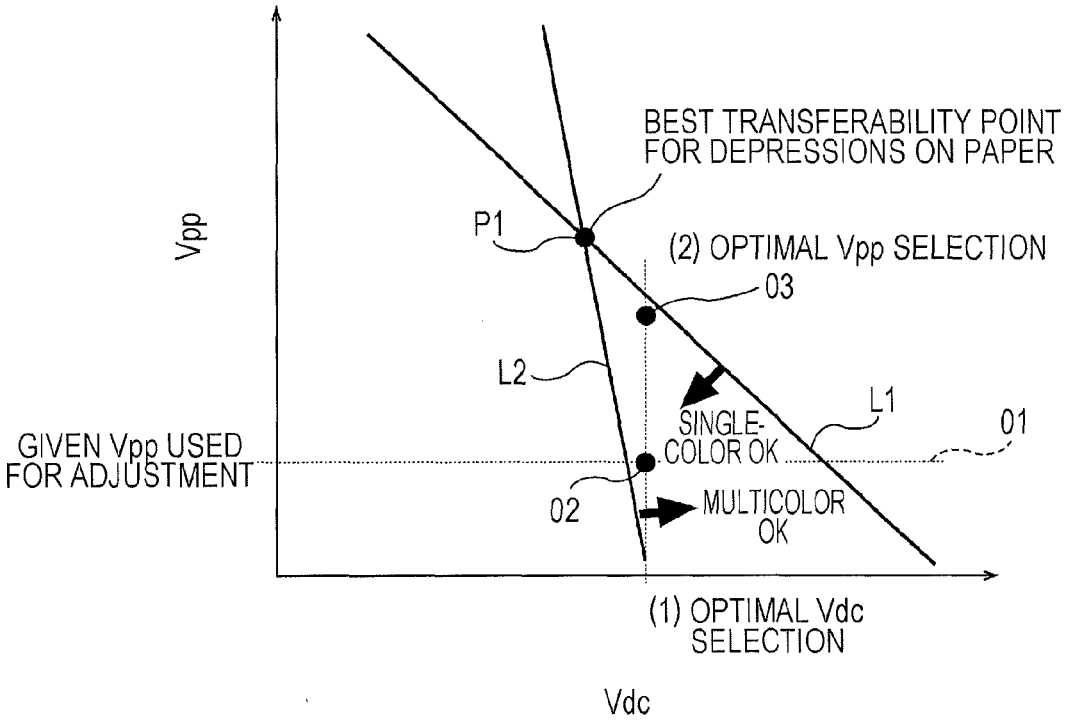
FIG. 9 RELATED ART
FIG. 9 illustrates a transfer voltage setting method according to related art.

FIG. 9 illustrates a transfer voltage setting method according to related art.

In this regard, Japanese Unexamined Patent Application Publications Nos. 2012-123309 ([0059] to [0074], [0102] to [0112], FIG. 7) and 2012-42827 ([0047] to [0066], FIG. 9) exist as an example of related art.

Japanese Unexamined Patent Application Publications Nos. 2012-123309 and 2012-42827 describe a technique with which, by using a medium with large surface asperities such as Japanese paper, a black solid image is printed as a test image while varying both a DC voltage value (Voff) and the peak-to-peak value (Vpp) of an AC voltage, and density reproducibility for depressed areas, density reproducibility for projecting areas, and occurrence of white spots are evaluate. In the technique described in Japanese Unexamined Patent Application Publication No. 2012-123309, by using a straight line (L1) derived from the density reproducibility for depressed areas, a straight line (L2) derived from the density reproducibility for projecting areas, and a straight line (L3) derived from the occurrence of white spots, the DC voltage value and the peak-to-peak voltage value are set on the basis of a range bounded by these straight lines.

Japanese Unexamined Patent Application Publication No. 2012-123309 also describes a technique with which, first, with the peak-to-peak voltage value (Vpp) fixed to a given value, images are printed while varying the DC voltage value (Voff), and after an appropriate value of DC voltage is determined from the printed images, the DC voltage value is fixed to the determined appropriate value, and then images are printed in that state while varying the peak-to-peak voltage value (Vpp) to thereby determine an appropriate value of peak-to-peak voltage (Vpp) from the printed images.

However, exhaustively measuring DC voltage and peak-to-peak voltage values as described in Japanese Unexamined Patent Application Publications Nos. 2012-123309 and 2012-42827 is a time-consuming and cumbersome process. With the method of deriving an appropriate value of DC voltage and then using the derived appropriate value of DC voltage to derive an appropriate value of peak-to-peak voltage as described in Japanese Unexamined Patent Application Publication No. 2012-123309, as illustrated in FIG. 9, an appropriate value 02 of DC voltage value is derived while the peak-to-peak voltage is fixed to a given value 01, and the derived appropriate value 02 of DC voltage is used to derive an appropriate value of peak-to-peak voltage. Therefore, the transfer voltage is set to a value different from the value of the intersection P1 of the single-color straight line L1 and the multicolor straight line L2 which represents the optimal value for the combination of the DC voltage value and the peak-to-peak voltage value. That is, with the method described in Japanese Unexamined Patent Application Publications No. 2012-123309, it is difficult to set the DC voltage value and the peak-to-peak voltage value with good precision.

In contrast, in Exemplary Embodiment 1, the second transfer voltage is set on the basis of the intersection P1 of the single-color straight line L1 and the multicolor straight line L2.

Experiment Example

Next, an experiment is conducted to confirm the effect of Exemplary Embodiment 1. The Color 1000 Press manufactured by Fuji Xerox Co., Ltd. is modified and used to conduct the experiment. The experiment is conducted under the environmental conditions of a temperature of 22° C. and a humidity of 55%. Embossed paper is used as the recording sheet.

The values of Vpp1, Vpp2, Vdc, and the like are set similarly to those of Exemplary Embodiment 1.

The results of the experiment are illustrated in FIG. 10.

FIG. 10 illustrates the results of the experiment.

In FIG. 10, in the case of multicolor printing performed at 7 kVpp, Vdc=−2.3 kV. Therefore, the second multicolor value is obtained as (Vdc4, Vpp2)=(−2.2 kV, 7 kVpp). Likewise, the second single-color value is obtained as (Vdc3, Vpp2)=(−3.0 kV, 7 kVpp), the first multicolor value is obtained as (Vdc2, Vpp1)=(−2.0 kV, 12 kVpp), and the first single-color value is obtained as (Vdc1, Vpp1)=(−2.3 kV, 12 kVpp).

Therefore, the single-color straight line L1 is obtained by Equation (1) below.

$$L1: Y=7.14\times10^3\times X+28.43\times10^3 \quad \text{Equation (1)}$$

The multicolor straight line L2 is obtained by Equation (2) below.

$$L2: Y=25.00\times10^3\times X+62.00\times10^3 \quad \text{Equation (2)}$$

Therefore, from Equation (1) and Equation (2), the intersection P1 is obtained as P1=(1.88 kV, 15.00 kVpp).

For confirmation, Vdc and Vpp are respectively set to 1.88 kVdc and 15 kVpp, and images are output on embossed paper. As a result, an acceptable level of density is attained for projections on the embossed paper in the case of both multicolor printing and single-color printing, and an acceptable level of density is also attained for depressions on the embossed paper. Therefore, the effect of Exemplary Embodiment 1 is confirmed.

Exemplary Embodiment 2

Figure 11:
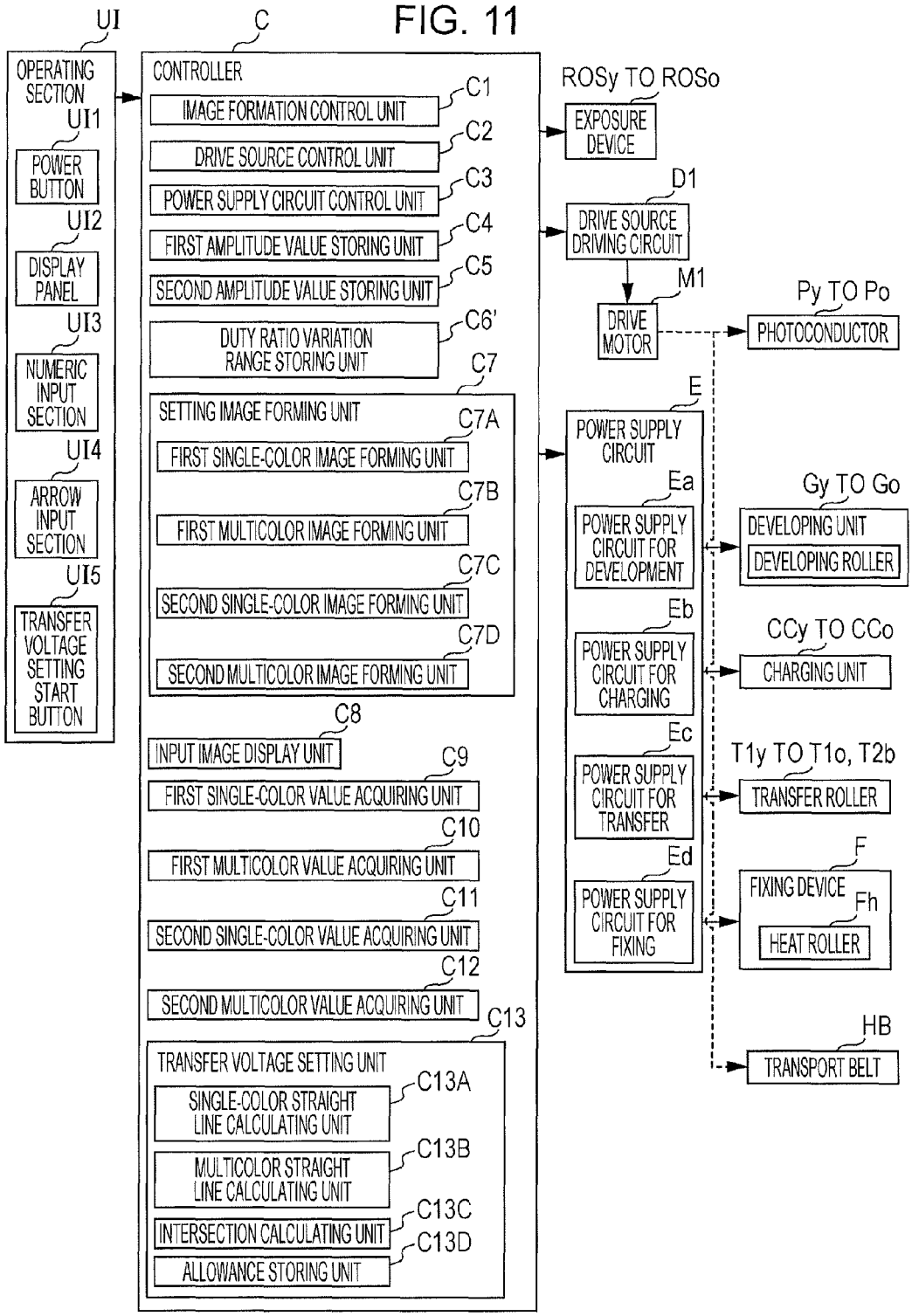
FIG. 11 is an illustration, corresponding to FIG. 4 according to Exemplary Embodiment 1, of a controller of an image forming apparatus according to Exemplary Embodiment 2.

FIG. 11 is an illustration, corresponding to FIG. 4 according to Exemplary Embodiment 1, of a controller of an image forming apparatus according to Exemplary Embodiment 2.

Next, Exemplary Embodiment 2 of the present invention will be described. In the following description of Exemplary Embodiment 2, components identical to those in Exemplary Embodiment 1 above are denoted by the same symbols, and a detailed description of those components is omitted.

Although Exemplary Embodiment 2 differs from Exemplary Embodiment 1 in the following respects, Exemplary Embodiment 2 is otherwise similar to Exemplary Embodiment 1 mentioned above.

Figure 12A:
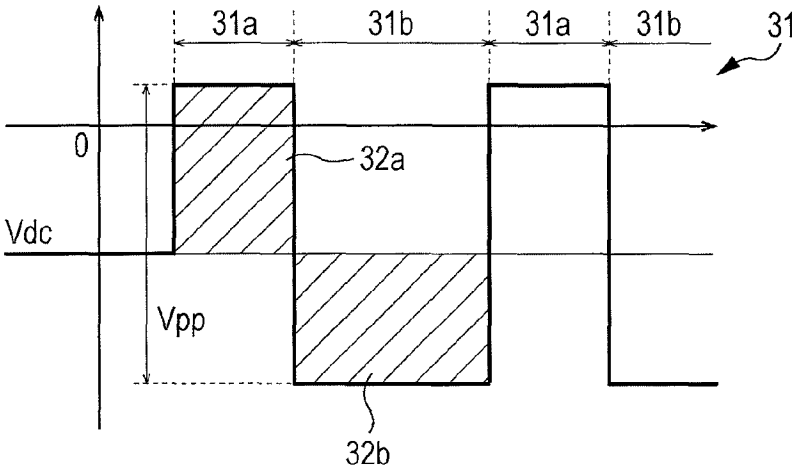
Figure 12B:
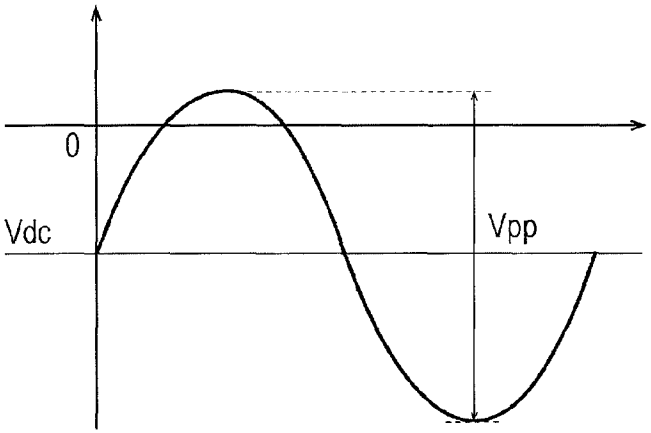
Figure 12C:
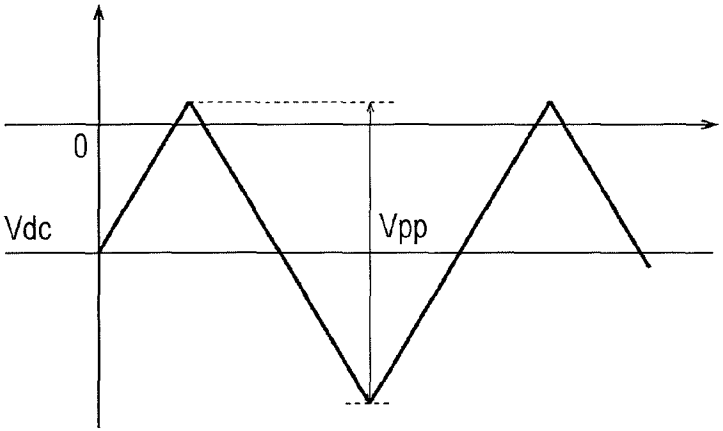
Figure 12D:
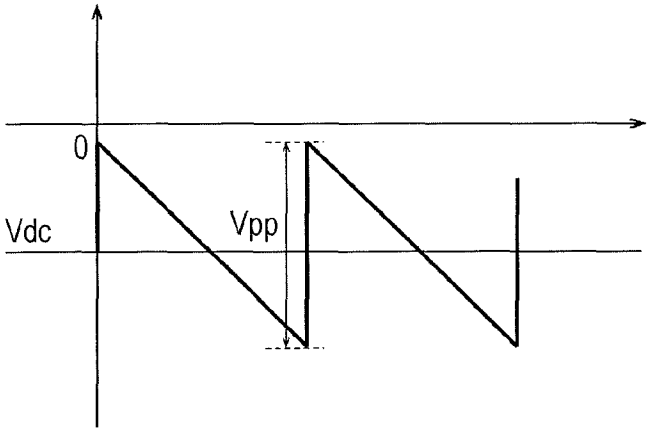

FIGS. 12A to 12D each illustrate an AC voltage. FIG. 12A illustrates an AC voltage with a rectangular waveform used in Exemplary Embodiment 2, FIG. 12B illustrates an AC voltage with a sinusoidal waveform used in Exemplary Embodiment 1, FIG. 12C illustrates a triangular wave, and FIG. 12D illustrates a saw-tooth wave.

In FIG. 11, the controller C of the printer U according to Exemplary Embodiment 2 has a duty ratio variation range storing unit C6' as an example of a waveform width variation range storing unit, instead of the DC voltage variation range storing unit C6 of the controller C according to Exemplary Embodiment 1.

The duty ratio variation range storing unit C6' according to Exemplary Embodiment 2 stores the variation range of a duty ratio, which is the ratio of the duration of the positive-side rectangular wave portion to that of the negative-side rectangular wave portion of an AC voltage. In Exemplary Embodiment 2, a rectangular wave 31 as illustrated in FIG. 12A is used as an example of an AC bias.

In the case of a sinusoidal wave used in Exemplary Embodiment 1 as illustrated in FIG. 12B, only the amplitude Vpp and the period (frequency) may be readily adjusted. However, in the case of the rectangular wave 31, in addition to the amplitude Vpp and the period T, it is also possible to control the duty ratio that is the ratio in duration between a positive-side rectangular wave portion 31*a* and a negative-side rectangular wave portion 31*b* within one period of the rectangular wave 31. Changing the duty ratio to increase the ratio of the positive-side rectangular wave portion 31*a* causes a positive-side area 32*a* in FIG. 12A to become larger than a negative-side area 32*b*, which is equivalent in overall effect to changing Vdc to the positive side. Conversely, increasing the ratio of the negative-side rectangular wave portion 31*b* is equivalent in overall effect to changing Vdc to the negative side. Therefore, changing the duty ratio provides substantially the same effect as changing the DC voltage value Vdc in Exemplary Embodiment 1. In Exemplary Embodiment 2, the DC voltage value Vdc is set to, for example, −2.0 kV.

Therefore, processes similar to those in Exemplary Embodiment 1 are performed in Exemplary Embodiment 2, except for only that, instead of changing the DC voltage value Vdc as in Exemplary Embodiment 1, the duty ratio as a parameter related to the waveform shape of an alternative bias is changed in Exemplary Embodiment 2. That is, processes such as forming the setting image 11, deriving the single-color straight line L1 and the multicolor straight line L2, and calculating the intersection P1 are also performed in a manner similar to Exemplary Embodiment 1. Accordingly, a description of a block diagram or flowchart will be omitted for brevity.

Exemplary Modifications

While exemplary embodiments of the present invention have been described above in detail, exemplary embodiments of the present invention are not limited to the above exemplary embodiments but various modifications are possible within the scope of the invention as defined in the claims. Exemplary modifications (H01) to (H07) of the present invention are given below.

(H01) While the above exemplary embodiments are directed to an example in which the image forming apparatus is implemented as the printer U, this is not to be construed restrictively. The image forming apparatus may be also implemented by, for example, a copying machine, a facsimile, or a multi-function machine having some or all of their functions.

(H02) While the above exemplary embodiments are directed to an example in which five colors of developer are used in the printer U, this is not to be construed restrictively. The exemplary embodiments are also applicable to, for example, an image forming apparatus that forms multicolor images having four or less colors or six or more colors.

(H03) The specific numeric values and parameters described by way of example in the above exemplary embodiments may be changed as desired in accordance with design, specifications, and the like. That is, the steps in which the DC voltage value Vdc is varied may be changed from 100 V. Further, while the above exemplary embodiments are directed to an example in which the first amplitude value Vpp1 and the second amplitude value Vpp2 have a difference of 5 kVpp, this is not to be construed restrictively. However, for the purpose of calculating the two straight lines L1 and L2, it is desirable that the two amplitude values have a difference of about 3 kVpp or more. The margin L3 may be also changed as desired. For example, it is also possible to set the margin to zero.

(H04) While the above exemplary embodiments are directed to an example in which the four kinds of images 12 to 15 are formed on a single recording sheet S as the setting image 11, this is not to be construed restrictively. For example, it is also possible to print the images 12 and 13 on a single recording sheet S, and print the images 14 and 15 on another single recording sheet S. At this time, it is also possible to accept an input of the first single-color value and the first multicolor value upon printing and output of the recording sheet S printed with the images 12 and 13, and after the first single-color value and the first multicolor value are input, print and output the recording sheet S printed with the images 14 and 15, and accept an input of the second single-color value and the second multicolor value.

Alternatively, it is also possible to print one of the four kinds of images 12 to 15 on a single the recording sheet S, thus outputting a total of four recording sheets S. In this case as well, it is possible to accept an input of a value each time a single recording sheet S is printed. Alternatively, it is possible to accept an input of a value each time two recording sheets S are printed, or accept an input after all the recording sheets S are printed.

(H05) While the above exemplary embodiments are directed to an example in which each of the single-color straight line L1 and the multicolor straight line L2 are calculated by using two points, this is not to be construed restrictively. For example, each of the single-color straight line L1 and the multicolor straight line L2 may be derived by acquiring three values and then using least square approximation.

(H06) while the above exemplary embodiments are directed to an example in which the DC voltage value Vdc is changed while the peak-to-peak voltage Vpp is fixed to Vpp1 or Vpp2, this is not to be construed restrictively. For example, it is also possible to fix the DC voltage value Vdc to one of two values, and vary the peak-to-peak voltage Vpp to thereby acquire four values.

(H07) While the above exemplary embodiments are directed to an example in which a voltage value is used as an example of a bias value, a current value may be used as well.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image by using toner;

an image carrier;

a transfer unit that transfers an image from the image carrier to a medium; and a power supply control unit that applies a transfer bias to the transfer unit, the transfer bias being generated by superimposing an AC bias and a DC bias on each other, wherein a plurality of first images are transferred to a medium, the first images being formed by setting one of an amplitude value of the AC bias and a DC bias value representing the DC bias to a fixed value and changing another one of the amplitude value and the DC bias value at a preset interval, and wherein a plurality of second images are transferred to a medium, the second images being formed by setting the one of the amplitude value and the DC bias value to a fixed value different from the fixed value, and changing the other one of the amplitude value and the DC bias value at a preset interval.

2. The image forming apparatus according to claim 1, wherein:

the first images include a first single-color image formed by using one kind of toner, and a first multicolor image formed by laying a plurality of kinds of toner on each other; and the second images include a second single-color image formed by using one kind of toner, and a second multicolor image formed by laying a plurality of kinds of toner on each other.

3. The image forming apparatus according to claim 2, further comprising an input unit that receives an input of first information and second information, the first information being related to one of a plurality of the first single-color images and one of a plurality of the first multicolor images, the second information being related to one of a plurality of the second single-color images and one of a plurality of the second multicolor images.

4. The image forming apparatus according to claim 3, further comprising a transfer bias setting unit that sets at least one of the AC bias and the DC bias from the first information and the second information input from the input unit.

5. The image forming apparatus according to claim 1, wherein the first images and the second images are formed on a single medium.

6. An image forming apparatus comprising:

an image carrier;

a transfer unit that transfers an image from the image carrier to a medium;

a power supply control unit that applies a transfer bias to the transfer unit, the transfer bias being generated by superimposing an AC bias and a DC bias on each other, the AC bias being a bias that varies periodically;

a first single-color image forming unit that forms a first single-color image on a medium every time when, while one of an amplitude value and a DC bias value is set to a fixed value, another one of the amplitude value and the DC bias value is changed at a preset interval, the amplitude value representing a difference between a maximum value and a minimum value of an amplitude of the AC bias, the DC bias value representing a value of the DC bias;

a first multicolor image forming unit that forms a first multicolor image on a medium every time when, while one of the amplitude value and the DC bias value is set to a fixed value, another one of the amplitude value and the DC bias value is changed at a preset interval;

a second single-color image forming unit that forms a second single-color image on a medium every time when, while the one of the amplitude value and the DC bias value set to the fixed value by the first single-color image forming unit is set to a fixed value different from the fixed value, the other one of the amplitude value and the DC bias value is changed at a preset interval;

a second multicolor image forming unit that forms a second multicolor image on a medium every time when, while the one of the amplitude value and the DC bias value set to the fixed value by the first multicolor image forming unit is set to a fixed value different from the fixed value, the other one of the amplitude value and the DC bias value is changed at a preset interval;

an input image display unit that displays, on a display, an image used to input a first single-color value, an image used to input a first multicolor value, an image used to input a second single-color value, and an image used to input a second multicolor value, the first single-color value having the amplitude value and the DC bias value corresponding to the first single-color image whose image quality is at an acceptable limit among a plurality of the first single-color images formed by the first single-color image forming unit, the first multicolor value having the amplitude value and the DC bias value corresponding to the first multicolor image whose image quality is at an acceptable limit among a plurality of the first multicolor images formed by the first multicolor image forming unit, the second single-color value having the amplitude value and the DC bias value corresponding to the second single-color image whose image quality is at an acceptable limit among a plurality of the second single-color images formed by the second multicolor image forming unit, and the second multicolor value having the amplitude value and the DC bias value corresponding to the second multicolor image whose image quality is at an acceptable limit among a plurality of the second multicolor images formed by the second multicolor image forming unit;

an input unit that allows a user to make an input; and a transfer voltage setting unit that sets at least one of a waveform shape of the AC bias applied to the transfer unit and the DC bias value, within a region on a graph of the amplitude value and the DC bias value and on a basis of an intersection of a single-color straight line and a multicolor straight line, the single-color straight line being a line connecting the first single-color value and the second single-color value input from the input unit, the multicolor straight line being a line connecting the first multicolor value and the first multicolor value input from the input unit, the region being bounded by a region located closer to an origin of the graph than the single-color straight line and a region located on a side opposite to the origin with respect to the multicolor straight line.

7. The image forming apparatus according to claim 6, wherein:

the first single-color image forming unit and the first multicolor image forming unit respectively form the first single-color image and the first multicolor image on a single medium; and the input image display unit displays the image used to input the first single-color value and the image used to input the first multicolor value, in response to output of a single medium on which the first single-color image and the first multicolor image are formed.

8. The image forming apparatus according to claim 6, wherein:

the first single-color image forming unit and the first multicolor image forming unit respectively form the first single-color image and the first multicolor image on a single medium;

the input image display unit displays the image used to input the first single-color value and the image used to input the first multicolor value, in response to output of a single medium on which the first single-color image and the first multicolor image are formed;

the second single-color image forming unit and the second multicolor image forming unit respectively form the second single-color image and the second multicolor image on a single medium, in response to input of the first single-color value and the first multicolor value; and the input image display unit displays the image used to input the second single-color value and the image used to input the second multicolor value, in response to output of a single medium on which the second single-color image and the second multicolor image are formed.

9. The image forming apparatus according to claim 6, wherein:

the first single-color image forming unit and the first multicolor image forming unit respectively form the first single-color image and the first multicolor image on a single medium; and the second single-color image forming unit and the second multicolor image forming unit respectively form the second single-color image and the second multicolor image on a single medium, after output of a medium on which the first single-color image and the first multicolor image are formed.

10. The image forming apparatus according to claim 6, wherein the first single-color image, the first multicolor image, the second single-color image, and the second multicolor image are formed on a single medium.

11. The image forming apparatus according to claim 6, wherein:

the first single-color image forming unit forms the first single-color image every time when the DC bias value is changed at an interval of a preset bias value while the amplitude value is fixed to a first amplitude value that is set in advance;

the first multicolor image forming unit forms the first multicolor image every time when the DC bias value is changed at an interval of a preset bias value while the amplitude value is fixed to the first amplitude value;

the second single-color image forming unit forms the second single-color image every time when the DC bias value is changed at an interval of a preset bias value while the amplitude value is fixed to a second amplitude value different from the first amplitude value; and the second multicolor image forming unit forms the second multicolor image every time when the DC bias value is changed at an interval of a preset bias value while the amplitude value is fixed to the second amplitude value.

12. A transfer bias setting method which sets a transfer bias applied to a transfer unit, the transfer bias being generated by superimposing an AC bias and a DC bias on each other, comprising;

acquiring a first single-color value from a plurality of single-color images, the single-color images being each formed every time when, while one of an amplitude value and a DC bias value is set to a fixed value, another one of the amplitude value and the DC bias value is changed at a preset interval, the amplitude value representing a difference between a maximum value and a minimum value of the AC bias, the DC bias value representing a value of the DC bias, the first single-color value having the amplitude value and the DC bias value corresponding to one of the single-color images whose image quality is at an acceptable limit;

acquiring a first multicolor value from a plurality of multicolor images, the multicolor images being each formed every time when, while one of the amplitude value and the DC bias value is set to a fixed value, another one of the amplitude value and the DC bias value is changed at a preset interval, the first multicolor value having the amplitude value and the DC bias value corresponding to one of the multicolor images whose image quality is at an acceptable limit;

acquiring a second single-color value from a plurality of single-color images, the single-color images being each formed every time when, while the one of the amplitude value and the DC bias value of the first single-color value is set to a fixed value different from the fixed value set for the first single-color value, the other one of the amplitude value and the DC bias value is changed at a preset interval, the second single-color value having the amplitude value and the DC bias value corresponding to one of the single-color images whose image quality is at an acceptable limit;

acquiring a second multicolor value from a plurality of multicolor images, the multicolor images being each formed every time when, while the one of the amplitude value and the DC bias value of the first multicolor value is set to a fixed value different from the fixed value set for the first multicolor value, the other one of the amplitude value and the DC bias value is changed at a preset interval, the second multicolor value having the amplitude value and the DC bias value corresponding to one of the multicolor images whose image quality is at an acceptable limit; and setting at least one of a waveform shape of the AC bias applied to the transfer unit and the DC bias value, within a region on a graph of the amplitude value and the DC bias value and on a basis of an intersection of a single-color straight line and a multicolor straight line, the single-color straight line being a line connecting the first single-color value and the second single-color value input from the input unit, the multicolor straight line being a line connecting the first multicolor value and the first multicolor value input from the input unit, the region being bounded by a region located closer to an origin of the graph than the single-color straight line and a region located on a side opposite to the origin with respect to the multicolor straight line.

* * * * *